US011682298B2

(12) United States Patent
Vaudrin

(10) Patent No.: US 11,682,298 B2
(45) Date of Patent: Jun. 20, 2023

(54) PRACTICAL METHOD TO COLLECT AND MEASURE REAL-TIME TRAFFIC DATA WITH HIGH ACCURACY THROUGH THE 5G NETWORK AND ACCESSING THESE DATA BY CLOUD COMPUTING

(71) Applicant: François Vaudrin, Quebec (CA)

(72) Inventor: François Vaudrin, Quebec (CA)

( * ) Notice: Subject to any disclaimer, the term of this patent is extended or adjusted under 35 U.S.C. 154(b) by 30 days.

(21) Appl. No.: 17/409,640

(22) Filed: Aug. 23, 2021

(65) Prior Publication Data

US 2023/0057931 A1 Feb. 23, 2023

(51) Int. Cl.
*G08G 1/07* (2006.01)
*G08G 1/01* (2006.01)

(52) U.S. Cl.
CPC ..... *G08G 1/07* (2013.01); *G08G 1/0104* (2013.01)

(58) Field of Classification Search
CPC ..... G08G 1/07; G08G 1/0104
See application file for complete search history.

(56) References Cited

U.S. PATENT DOCUMENTS

| | | | | |
|---|---|---|---|---|
| 10,742,399 | B2 * | 8/2020 | Chen | G06F 18/213 |
| 2019/0043201 | A1 * | 2/2019 | Strong | G06F 18/211 |
| 2019/0045207 | A1 * | 2/2019 | Chen | H04L 67/51 |
| 2019/0251837 | A1 * | 8/2019 | Vrabete | G08G 1/0145 |
| 2019/0347931 | A1 * | 11/2019 | Ding | G08G 1/0145 |
| 2020/0152057 | A1 * | 5/2020 | Roy | G08G 1/0145 |
| 2021/0194674 | A1 * | 6/2021 | Chen | G06T 7/11 |

* cited by examiner

*Primary Examiner* — Sisay Yacob

(57) ABSTRACT

The present method permits to get real-time traffic data by the mean of pictures took by a series of georeferenced and synchronized high speed cameras installed on the portions of the road. These pictures and these data will be transferable by a secure means such as 5G or any other fast and secure technology on a server and accessible by cloud computing. Picture processing is carried out by photogrammetric, triangulation and picture recognition approaches in order to extract the position of each vehicle, pedestrian, cyclist or any object and identify its x, y, z coordinates in a local or global referencing system. This method permits to count the flow of traffic (vehicles, pedestrians, etc.) passing through these roads portions, to reproduce the real movements of vehicles, pedestrians and any object moving on a road, make simulations with a computer and intervene remotely in real-time to manage traffic.

19 Claims, 3 Drawing Sheets

PRACTICAL METHOD TO COLLECT AND MEASURE REAL-TIME TRAFFIC DATA WITH HIGH ACCURACY THROUGH THE 5G NETWORK AND ACCESSING THESE DATA BY CLOUD COMPUTING

BACKGROUND OF THE INVENTION

The present invention belongs to the field of Transportation and Traffic research as well as the methodologies behind them.

Existing Current Systems

To update traffic control systems and conduct traffic studies, it is essential to have reliable, accurate and up-to-date data on traffic flows. However, these data are generally unavailable, not recent enough, imprecise or difficult to access.

In addition, there is no simple, efficient and economical method of collecting traffic data and the most reliable is still the manual method. This method involves sending a technician to the field to manually count traffic flows in all directions. This is a process that spans several days and must be repeated regularly to take into account changes in traffic flows, new developments or improvements to the road network. This is a tedious and expensive process that requires staff and frequent trips on the road network.

Data can also be collected by origin-destination (O/D) surveys, but this is an expensive and difficult method to optimize traffic light systems. Regarding data from mobile devices and GPS navigation systems, they are disseminated among several providers and there are legal, security and privacy issues to consider. In addition, it is necessary to take into account the latency problem which causes delays in satellite transmission. This problem can interfere with real-time interventions for traffic control.

There are also methods of collecting traffic data such as installing devices permanently along the roads. These are detectors or sensors generally connected to an on-site computer or to a laptop. The disadvantages of this method relate to the wide variety of equipment on the market, their installation, the difficulty of making them work correctly and the complexity of the data processing.

Our method is new and different from existing methods. This is a photogrammetric, triangulation and picture recognition approach. It provides for the installation of a series of georeferenced and synchronized cameras which will be able to measure traffic flows simultaneously on several intersections or sections of the roads. In addition to traffic flows, it makes it possible to measure the position, speed, acceleration and traffic density of vehicles, pedestrians, cyclists and any object that moves in the area under study and to process these data in a microscopic simulator or any kind of simulator. The data will also be accessible by secure means and by cloud computing.

Furthermore, some inventions have caught our attention, WO 2004/021303 "Method and device for determining traffic condition quantities" filed on 21 Aug. 2003 shows a method and arrangement for determining traffic condition variables. A video camera records video pictures of a lane with vehicles. This method determines traffic state variables, such as traffic flow speed and traffic density, from gray scale values of the video picture. This is a rough estimate of the traffic condition and it does not determine the exact position of vehicles, pedestrians, cyclists or any object moving on a road as we propose in our invention.

WO 95/25321 "Method of detecting traffic and traffic situations on roads, preferably motorways" filed Jan. 3, 1995. The method arranges measuring points for vehicle detection using traffic sensors and a traffic data processing arrangement for traffic control are used to determine at regular intervals traffic data, such as vehicle speed, traffic intensity and traffic density. And specific traffic parameters determined therefrom are formed in a traffic data processing system. This method calculates the average speed of traffic at regular intervals with sensors placed in sections across a road section and does not determine the exact position of vehicles, pedestrians, cyclists or any object. which moves on a road as we propose in our invention.

Objectives and Advantages

The main objective is to propose a practical method to count the flow of vehicles, pedestrians, cyclists or any object moving on a section of road and to measure the traffic density in order to be able to intervene in real time and at the right time to better control the traffic systems.

Another principal objective is to offer an automatic real-time solution of measuring the traffic flow on a road section or an intersection, the position at any moment of vehicles, pedestrians, cyclists and any moving object and to measure the density of traffic precisely in each section of road in real time. Another objective is to make these data readily and easily available to optimize the static traffic light systems of cities and agencies, to dynamically modify traffic light systems in real time, to dynamically modify traffic control systems (changing average vehicle speed, informing drivers for improving traffic flow, etc.), to carry out various traffic studies or for other uses related to transport and mobility.

The counting of vehicles could be done more frequently, it is less costly in the long run and it is more practical and simpler than the existing methods.

The present method offers a real-time solution of precise vehicle counting by the mean of high speed cameras shooting a very large number of pictures at road intersections or road sections. The pictures are taken every fraction of a second for example to identify and measure precisely the flow of vehicles, of pedestrians, cyclists, animals or of any other object moving on a section of the road or through an intersection. These pictures are transferred to a server by the 5G or any other fast and secure technology for processing. They can also be processed on site with the "edge computing" approach. Pictures processing is carried out by photogrammetric, triangulation and picture recognition approaches in order to extract the position of each vehicle, pedestrian, cyclist or any object and identify its x, y, z coordinates in a local or global referencing system. This method makes it possible to deduce the traffic flows in a faster and more practical way than the methods in force. It can also extract other useful information such as position, average speed or traffic density, which the manual counting method and other methods do not. These pictures and data will be immediately transferred through a fast and secure means for real-time use or stored on a server for processing and future use. The access to the data reported by the pictures are available in the cloud computing and could be used by cities, agencies, and other specialists in urban planning, transport or mobility.

My invention offers the present advantages:

- A real-time collected data easily accessible by cloud computing, 5G or any other fast, secure and similar technology,
- A better quality of the traffic data is collected,
- An easily utilization of the data by cities, agencies, public bodies or other person interested in improving mobility or studying traffic phenomena, The formatting and presentation of the data can be automated in the same format as currently used by cities and agencies to optimize current Traffic Lights Systems.

The formatting and presentation of the data can be automated in the same format as currently used by cities and agencies for the use of simulation and optimization software.

This method will make it possible to simulate reality with more precision than current simulators; current simulators represent an imprecise glimpse of reality which use statistical rules to generate the arrival of vehicles and vehicle journeys from statistical rules such as Poisson's Law, and which generates journeys from mathematical models such as the "car-following-model".

This method makes it possible to reproduce the real movements of vehicles, pedestrians, cyclists or other objects which move at every split second, processes this data in the right format and transfer it into a simulator and in real-time if necessary.

The data collected with this method combined with the use of a micro-simulator or any type of simulator opens up unsuspected prospects for improving the performance of traffic systems and for the study of traffic phenomena such as the fundamental diagram and driver behaviours in different contexts.

Note: A microscopic simulator or micro-simulator reproduces the individual movements of vehicles, pedestrians or cyclists on a computer screen. The simulation makes it possible to test the efficiency of traffic control systems in force and to study traffic phenomena.

This method make it possible to evaluate the efficiency of a network by reproducing the movements in a micro-simulator and by measuring for example the cumulative waiting times on a part of the network as happens in reality. This measure is currently impossible to assess and cities and agencies rely on the decrease in the number of complaints to judge whether a system is effective or better than before.

This method allows to process the data in the right format and transfer it into a micro-simulator and in real-time if necessary.

The average speed, acceleration or any other information can be evaluated, and used to promote fluid circulation and mobility, reduce congestion waves, waiting times, energy waste and pollution.

This method makes it possible to know the traffic density at any time on a section of road and to remotely modify automatically or manually the cycles and phases of a Traffic Lights System from a Traffic Management Center.

Note: A Traffic Management Center (TMC) aims to monitor traffic signals, intersections, and roads and proactively deploys traffic management strategies to reduce congestion and improve mobility and security. For the purposes of this invention, the Traffic Management Center shown in FIG. 1 the number 34 includes related activities to traffic managements and planning. These activities are generally carried out by engineers, technicians and traffic experts from cities, agencies, public bodies or others, for example, analysis and management of traffic systems, urban studies, transport planning, optimization of static traffic light systems, etc.

This method makes it possible to use these data and carry out traffic studies or for any other purpose.

This method gives a good accuracy of vehicle positions near intersections in real time.

This method allows cities and agencies to update traffic light systems at the frequency recommended by industry standards and the Federal Highway Administration (FHWA), or even beyond those standards.

These general disadvantages are avoided:

manual counting of vehicles, a high number of workers to collect and treat data, a high cost of data collection and updating of systems.

The present invention will be further understood from the following description with reference to the drawings wherein like numbers refer to like parts for easy identification.

BRIEF DESCRIPTION OF DRAWINGS FIGURES

DETAILED DESCRIPTION OF THE PREFERRED EMBODIMENT

In the following description and in the accompanying drawings, the numeral numbers refer to identical parts in the various Figures.

Figure 1:
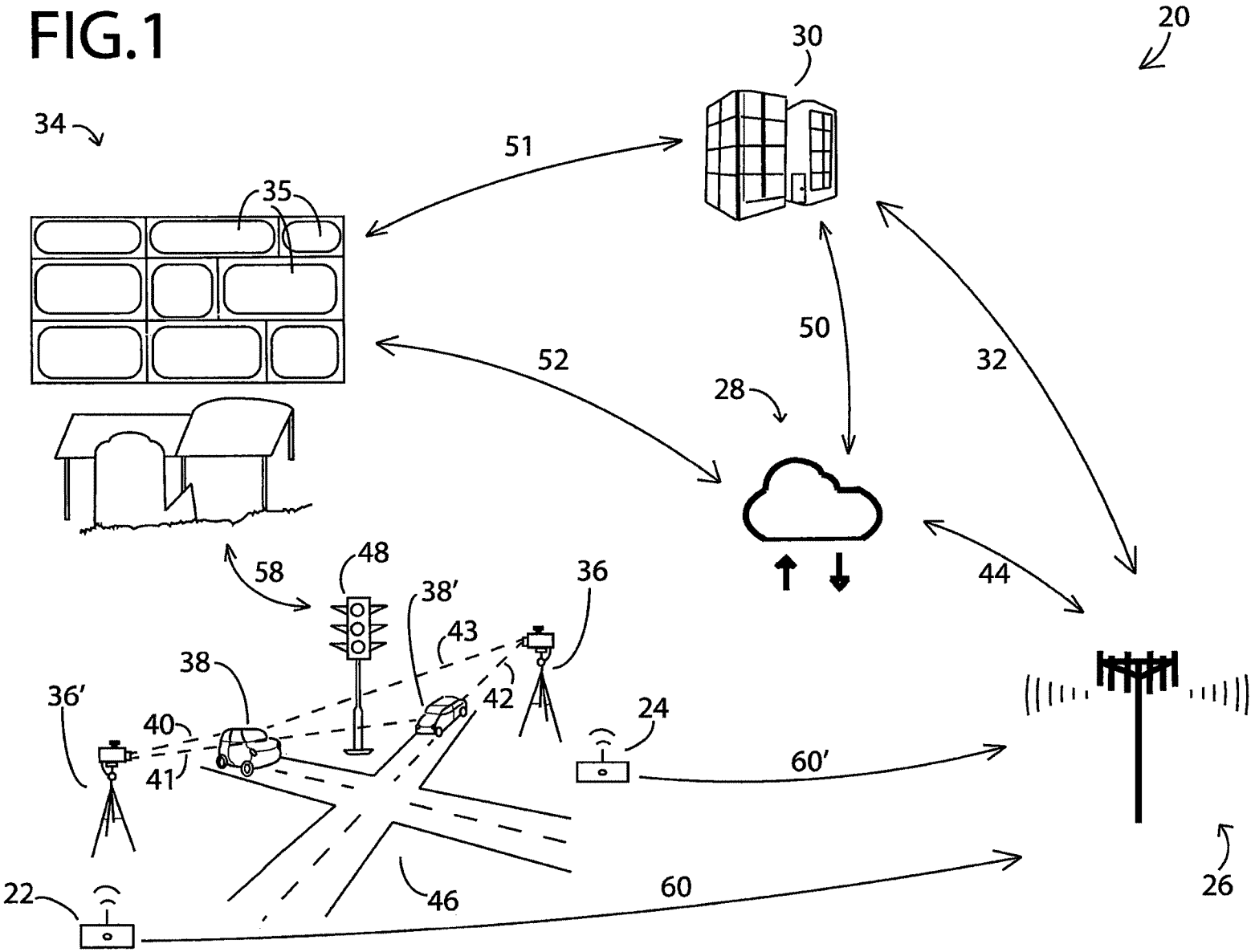
FIG. 1 is a complete view showing all the elements of the method.

FIG. 1 shows all the elements of the method 20, these elements comprise:

two high speed georeferenced and synchronised cameras 36,36' placed at roads intersection 46 and taking picture; the camera 36' is taking a picture 40 of the car 38 and a picture 41 of the car 38', the camera 36 is taking a picture 42 of the car 38' and a picture 43 of the car 38. These picture are taken from different angles of vehicles 38,38' at a high speed (several pictures per second).

A 5G network 26 connected respectively 60',60 through two small antennas or transmission accessories 24,22 to the high speed cameras 36,36'.

A Center of Analysis and Treatment 30 receives 32 the pictures from the 5G and processes them to obtain the real-time traffic data, the data are sent 50 to the cloud 28 where they are easily accessible. This is an automated way to get real-time traffic data and store them in the cloud for use by a city, agency, public bodies or others.

A Traffic Management Center 34 represented by a road viewing station, using screens and computers 35, where several decisions are made to manage traffic in real-time.

The Center of Analysis and Treatment 30 can transmit directly data 51 to the Traffic Management Center 34 by a fast and secure communication mean to permit to intervene dynamically and remotely to improve circulation and mobility, for example 58 to modify the sequences, cycles or phases of Traffic Lights System 48 in real time.

The links 58 between the Traffic Management Center 34 and the Traffic Lights System 48 is a secure mean of transmission like a dedicated Internet link, a fiber optic network or any secure and fast communication mean.

The pictures can be also transmit 44 directly to the cloud 28 where they are accessible to city, agencies, public bodies, or others 34 for some studies for example.

The city, agencies, public bodies, or others 34 now can access 52 the real-time traffic data from the cloud at any time and according to their needs.

The cities, agencies and public bodies can operate and optimize more frequently Traffic Lights Systems 48 with the data obtained 52 and previously processed by the Center of Analysis and Treatment 30.

Figure 2:
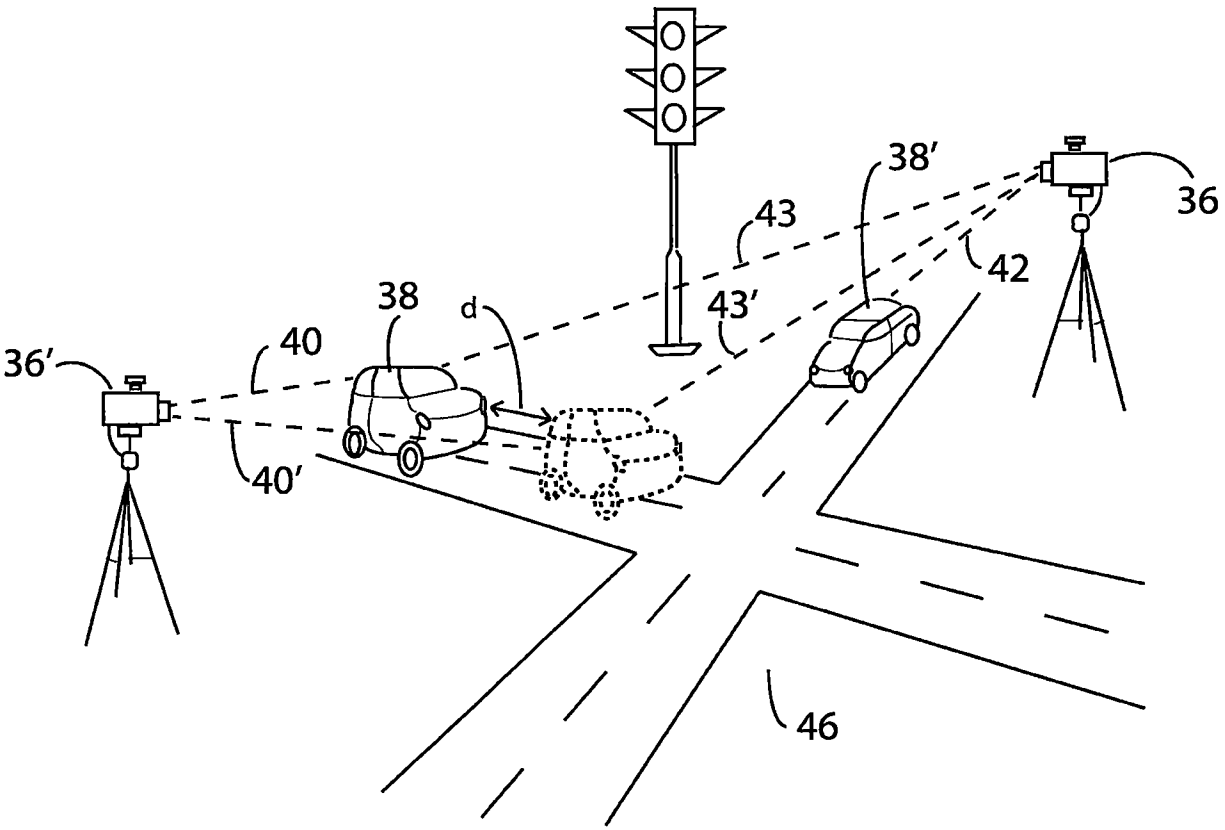
FIG. 2 is a perspective view of high speed cameras at a road intersection.

The city, agencies, public bodies or others receive also 51 some interventions or suggestions in real-time from the Center of Analysis and Treatment 30, for example, they may receive real-time traffic data just collected directly from the center 30 to avoid latency's loss. The links 51 can be for example a secure mean of transmission like a dedicated internet link, a direct communication network, a fiber optic network or any secure and fast communication mean. FIG. 2 shows the road intersection 46 where the high speed cameras 36',36 take pictures 40,40',42,43,43' of vehicles 38',38 from different angles. An example of consecutive photography is this, the photo 40' following the photo 40 is taken after the car 38 has driven a distance d by the camera 36', and the other camera 36 takes a photo 43' following the photo 43 of the same car 38 having driven a distance d. Photos 40 and 43 are taken simultaneously, by cameras 36, 36' as are photos 40' and 43' in a similar fashion.

Figure 3:
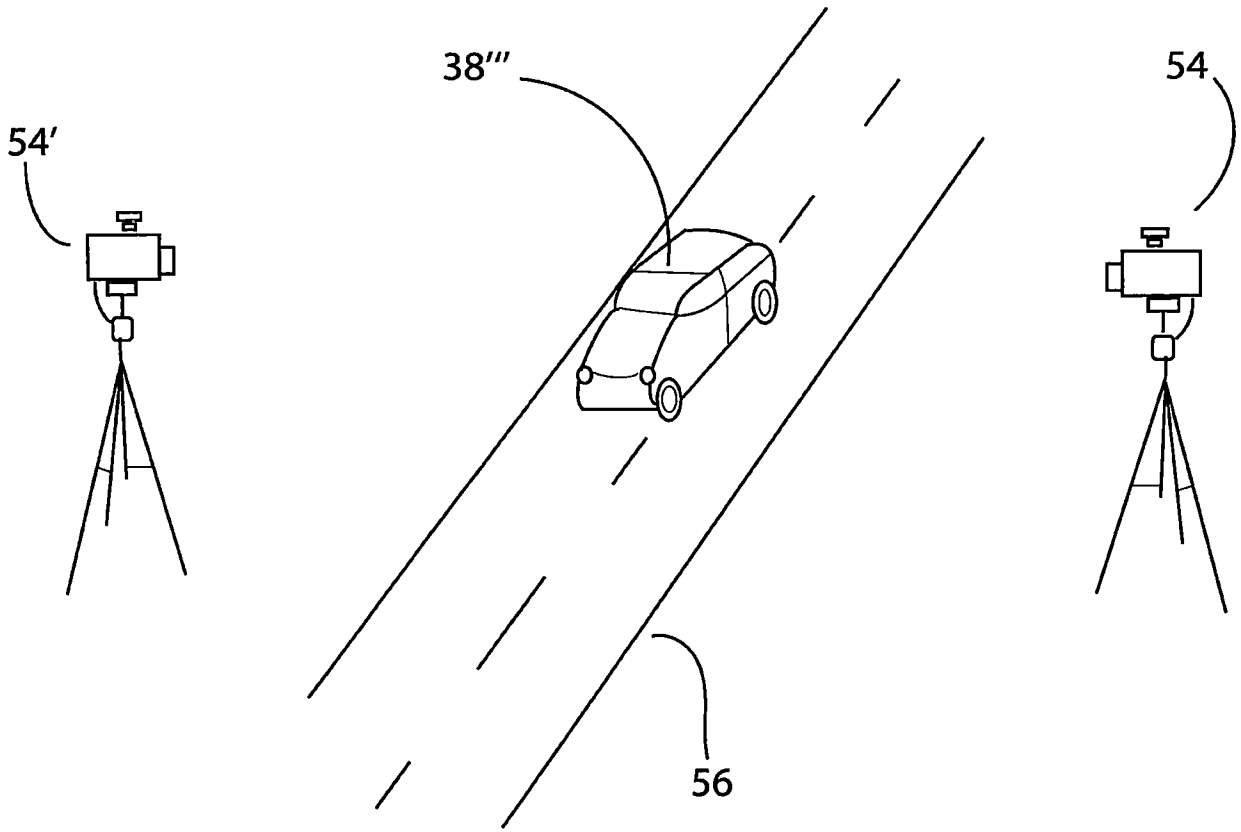
FIG. 3 is a perspective view of high speed cameras at a road section.

FIG. 3 shows a road section 56 where are high speed cameras 54,54' shooting pictures at every fraction of a vehicle 38''' in order to determine its position y, z) by triangulation at every moment.

SUMMARY OF THE INVENTION

The present invention is a method 20 of measuring real-time traffic data, accessing and processing that data by cloud computing.

The method utilizes high-speed cameras 36,36',54,54' connected to the 5G directly or via small antennas or transmission accessories 22,24. The 5G can be replace by any other fast and secure technology.

The high-speed cameras are installed in a suitable place or on the roadside ready to take pictures of a road section or an intersection of the road where are moving vehicles, pedestrians, cyclists, animals, or any other object.

The pictures are taken simultaneously like every fraction of a second to be able to identify vehicles, pedestrians, cyclists, animals or any other object moving on a section of the road or through an intersection and to be able to measure their position at every moment.

These cameras are georeferenced and synchronised to know the exact position (x, y, z) of vehicles, people, cyclists or other objects that are moving at any time.

Several cameras will be able to operate in a synchronized manner to compare the position of vehicles, people or other moving objects and thus increase the accuracy of the data.

The pictures will be sent to a Center of Analysis and Treatment 30 to be processed, these pictures will allow, after automated processing by artificial vision algorithm and triangulation or others approaches to recognize the exact position every split second of vehicles, pedestrians, cyclists or any other object that moves on a section of road or through an intersection.

In order to identify vehicles, pedestrians, objects or other moving objects in different lighting and visibility conditions, such as during the night and in various climatic conditions, lidar sensors and infrared cameras can be use in a similar fashion.

After processing the pictures, it will be possible to accurately measure traffic flows in all directions without installing expensive devices and without connecting them to the infrastructure or IT systems of a city or an agency. These data will be processable in the right format and accessible in the cloud to reduce data collection costs, field trips to collect data, and for easily and more frequently updating Traffic Light Systems. It will also allow transferring the data collected into a micro-simulator or any kind of simulator in order to better understand traffic phenomena, to develop more effective solutions adapted to the context, driving habits and local culture, and to carry out scientific research and new knowledge.

The data obtained after the treatment of the pictures are sent 50 in the cloud 28 and will be made available 52 to the Traffic Management Center 34 of cities, agencies, public bodies or others for different purposes; for example the management of traffic lights, the management of traffic control systems, carrying out studies and analyzes related to transport and urban planning. The city or agency can also update Traffic Lights Systems more frequently, especially static systems that should be updated every three years, but the majority of them are not updated frequently enough. The Traffic Management Center of cities, agencies and public bodies can receive real-time interventions or suggestions to improve traffic from the Center of Analysis and Treatment 30, by a fast and secure communication mean 51 in order to avoid latency's problems.

In Brief

A method for collecting and measuring real-time traffic data and to make them accessible through the cloud computing comprising the following steps:

a) choose a series of high speed Internet Protocol (IP) geo-referenced cameras,
b) install at least two cameras at portions of the road, intersection or road section, for shooting pictures at a high speed frequency of vehicles, pedestrians, cyclists, animals, objects moving at said portion,
c) synchronize these cameras so that they take series of pictures every fraction of a second and from different points of view simultaneously,
d) connect the cameras to the 5G network to transfer the pictures to a Center of Analysis and Treatment (30),
e) access and process the pictures in the Center of Analysis and Treatment (30) in order to obtain accurate real-time traffic data,
f) process the real-time traffic data by the said Center of Analysis and Treatment (30) in order to propose intervention scenarios to a Traffic Management Center (34) to enable it to intervene remotely, dynamically and in real time on Traffic Lights System (48) in order to improve traffic management and mobility,
g) send and store the data to the cloud and make it securely accessible and in the appropriate format to be usable by cities, agencies, public bodies and others.

These portions of the road are road sections or intersections.

The Center of Analysis and Treatment 30 processes the pictures by determining the area, the average volume, the position occupied by each of said vehicle, pedestrian, cyclist, animal or any moving object on said portion of said road and calculates their position (x, y, z) according to a local or global coordinate system to obtain said real-time traffic data.

The Center of Analysis and Treatment 30 can processes pictures with artificial intelligence approaches to obtain the real-time traffic data.

The high speed georeferenced-cameras shoot pictures at a very high speed; every fraction of a second.

The city, agency or public body is connected to the cloud for easy accessing the real-time traffic data, and may receive directly real-time interventions or suggestions from the Center of Analysis and Treatment 30 by a fast and secure communication mean 51, in order to avoid latency's problems. The city, agency or public body can manage transport and urban planning by the mean of these traffic data. An example of management is a city that remotely controls a Traffic Lights System 48 from a Traffic Management Center 34 and the Traffic Lights System 48 by a fast and secure mean of transmission like a dedicated internet link, a fiber optic network or any secure and fast communication mean.

The 5G can be modified, adapted, updated, renamed, or replaced over time by the responsible authorities or according to the rules of international standardization. The 5G can be replace by any other fast and secure technology.

In different lighting and visibility conditions on the roadside infrared cameras and lidar sensors can be used.

The real-time traffic data can be anonymized to respect privacy issues.

It is to be clearly understood that the instant description with reference to the annexed drawing is made in an indicative manner and that the preferred embodiments described herein are meant in no way to limit further embodiments realizable within the scope of the invention. The matter which is claimed as being inventive and new is limited only by the following claims.

| PARTS | |
|---|---|
| 20 | Method to collect and measure real-time traffic data with high accuracy through the 5G network and accessing these data by cloud computing |
| 22, 24 | Small antennas or transmission accessories |
| 26 | 5G 28 The cloud |
| 30 | Center of Analysis and Treatment of the pictures and data |
| 32 | Signal between the 5G and the Center of Analysis and Treatment |
| 34 | Traffic Management Center of cities, agencies or public bodies |
| 35 | Screens, computers, software, equipment to monitor and manage traffic systems |
| 36, 36' | High speed cameras at the road intersection |
| 38, 38', 38''' | Vehicles |
| 40, 40', 41 | Flashs of the camera 36' |
| 42, 43, 43' | Flash of the camera 36 |
| 44 | Signal between the cloud and the 5G |
| 46 | A road intersection 48 Traffic Lights System |
| 50 | Signal between the Center of Analysis and Treatment and the cloud |
| 51 | Real-time interventions transmission |
| 52 | Signal between the cloud and the city, agencies, public bodies 34 |
| 54 | A high speed camera in the road section 56 |
| 56 | A road section |
| 58 | Signal between the Traffic Management Center 34 and the Traffic Lights System 48 |
| 60, 60' | Signals between respectively small antennas or transmission accessories 22, 24 and the 5G 26 |

The embodiments of the invention in which an exclusive property or privilege is claimed are defined as follows:

1. A method for collecting and measuring real-time traffic data and accessing said real-time traffic data by cloud computing comprising the following steps:

(a) choose a series of high speed Internet Protocol (IP) geo-referenced cameras, (b) install at least two of high speed Internet Protocol (IP) geo-referenced cameras at portions of the road for taking series of pictures at a high speed frequency of vehicles, pedestrians, cyclists, animals, and objects moving at said portions, (c) synchronize the installed cameras so that they take series of pictures simultaneously every fraction of a second and from different points of view, (d) connect the installed cameras to a 5G network in order to transfer the series pictures fast and secure to a Center of Analysis and Treatment, (e) access and process the series pictures at said Center of Analysis and Treatment in order to obtain real-time traffic data, (f) process the obtained real-time traffic data at said Center of Analysis and Treatment in order to propose intervention scenarios to a Traffic Management Center to enable it to intervene remotely, dynamically and in real-time on Traffic Lights System in order to improve traffic management and mobility, (g) send the obtained real-time traffic data to the cloud computing and make it securely accessible and in the appropriate format to agencies, cities, public bodies and others for different uses according to their needs.

2. The method of claim 1, wherein said Center of Analysis and Treatment processes said series of pictures by determining an area, an average volume, a position (x, y, z) occupied by each of the vehicles, pedestrians, cyclists, animals, and objects on the portions of the road.

3. The method of claim 2, wherein said Center of Analysis and Treatment calculates the position (x, y, z) of said vehicles, pedestrians, cyclists, animals, and objects on the portions of the road according to a local coordinate system occupied by each of said vehicles, pedestrians, cyclists, animals, and objects on the portions of the road to obtain said real-time traffic data.

4. The method of claim 2, wherein said Center of Analysis and Treatment calculates the position (x, y, z) of said vehicles, pedestrians, cyclists, animals, and objects on the portions of the road according to a global coordinate system occupied by each of said vehicles, pedestrians, cyclists, animals, and objects on the portions of the road to obtain said real-time traffic data.

5. The method of claim 1, wherein said Center of Analysis and Treatment uses artificial intelligence approaches to obtain said real-time traffic data.

6. The method of claim 1, wherein said Traffic Management Center is connected to Traffic Lights System by a fast and secure communication system for commanding remotely said Traffic lights System in real-time.

7. The method of claim 1, wherein said portions are intersections of the road.

8. The method of claim 1, wherein said portions are a road sections.

9. The method of claim 1, wherein said high speed georeferenced-cameras take pictures every fraction of a second simultaneously.

10. The method of claim 1, wherein said cities are connected to said cloud computing for easy accessing said real-time traffic data.

11. The method of claim 1, wherein said, agencies, cities, public bodies and others manage transport, mobility and urban planning by the mean of said real-time traffic data.

12. The method of claim 1, wherein in different lighting and visibility conditions on the roadside said installed cameras are used with lidar sensors.

13. The method of claim 12, wherein said installed cameras are infrared cameras.

14. The method of claim 1, wherein said cities receives directly real-time interventions from said Center of Analysis and Treatment in order to avoid latency's loss.

15. The method of claim 1, wherein said 5G network can be modified, adapted, updated, renamed, or replaced over time by the responsible authorities.

16. The method of claim 1, wherein said 5G network can be modified, adapted, updated, renamed, or replaced over time according to the rules of international standardization.

17. The method of claim 1, wherein said real-time traffic data can be anonymized to respect privacy issues.

18. The method of claim 15, wherein said replacement is any other fast and secure technology.

19. The method of claim 16, wherein said replacement is any other fast and secure technology.

* * * * *